United States Patent [19]

Watanabe

[11] Patent Number: 4,524,451

[45] Date of Patent: Jun. 18, 1985

[54] SOUND REPRODUCTION SYSTEM HAVING SONIC IMAGE LOCALIZATION NETWORKS

[75] Inventor: Koji Watanabe, Hirakata, Japan

[73] Assignee: Matsushita Electric Industrial Co., Ltd., Osaka, Japan

[21] Appl. No.: 245,146

[22] Filed: Mar. 18, 1981

[30] Foreign Application Priority Data

| | | | |
|---|---|---|---|
| Mar. 19, 1980 | [JP] | Japan | 55-35261 |
| Jun. 19, 1980 | [JP] | Japan | 55-83619 |
| Jul. 18, 1980 | [JP] | Japan | 55-99237 |
| Sep. 24, 1980 | [JP] | Japan | 55-136530[U] |
| Oct. 6, 1980 | [JP] | Japan | 55-140324 |

[51] Int. Cl.[3] ..... H04R 5/04

[52] U.S. Cl. ..... 381/1; 381/19

[58] Field of Search ..... 179/1 G, 1 GQ, 1 GB, 179/1 GP; 381/1, 18, 19, 24

[56] References Cited

U.S. PATENT DOCUMENTS

| | | | |
|---|---|---|---|
| 3,214,519 | 5/1965 | Fouque . | |
| 3,236,949 | 2/1966 | Atal et al. | 179/1 G |
| 3,662,313 | 5/1972 | Komatsu | 179/1 GQ |
| 3,665,105 | 5/1972 | Chowning . | |
| 4,024,092 | 5/1980 | Bruney | 179/1 G |
| 4,118,599 | 10/1980 | Iwahara et al. | 179/1 GQ |
| 4,218,585 | 8/1980 | Carver | 179/1 G |
| 4,219,696 | 8/1980 | Kogure et al. | 179/1 G |

FOREIGN PATENT DOCUMENTS

| | | |
|---|---|---|
| 2309992 | 9/1974 | Fed. Rep. of Germany . |
| 2806914 | 8/1978 | Fed. Rep. of Germany . |
| WO81/03407 | 11/1981 | PCT Int'l Appl. . |

*Primary Examiner*—R. J. Hickey

*Attorney, Agent, or Firm*—Lowe, King, Price & Becker

[57] ABSTRACT

In a sound reproduction system having two loudspeakers located in front of a listener, an input audio signal is divided into a plurality of channel signals which are respectively applied through voltage adjusting devices to the front loudspeakers and also to additional speakers or localization networks to generate additional real or phantom sound sources at ±90 degrees to the normal to the listener. The additional sound sources and the front loudspeakers are located symmetrically with respect to the listener. By manual operation of the adjusting devices a sonic image can be localized at any point in the front half plane. Continual operation of the adjusting devices causes the localized sonic image to be moved continuously within the localizable area.

11 Claims, 32 Drawing Figures

| LOCALIZED AREA | | L | K | R |
|---|---|---|---|---|
| OUTPUT SIGNAL | 01 | | 0 | 0 |
| | 02 | | | 0 |
| | 03 | 0 | | |
| | 04 | 0 | 0 | |

| LOCALIZED AREA | | 0 | 0<D<A | A |
|---|---|---|---|---|
| OUTPUT SIGNAL | 01 | | | 0 |
| | 02 | 0 | | |
| | 03 | 0 | 0 | 0 |
| | 04 | | | 0 |

| LOCALIZED AREA | | L | K | R |
|---|---|---|---|---|
| SWITCH | 12a | ON | OFF | OFF |
| | 12b | OFF | ON | OFF |
| | 12c | OFF | OFF | ON |
| OUTPUT SIGNAL | O1 | | O | O |
| | O2 | | | O |
| | O3 | O | | |
| | O4 | O | O | |

FIG. 10
| LOCALIZED AREA | | L | K | R | R' | K' | L' |
|---|---|---|---|---|---|---|---|
| SWITCH | 12a | ON | OFF | OFF | OFF | OFF | OFF |
| | 12b | OFF | ON | OFF | OFF | OFF | OFF |
| | 12c | OFF | OFF | ON | OFF | OFF | OFF |
| | 12d | OFF | OFF | OFF | ON | OFF | OFF |
| | 12e | OFF | OFF | OFF | OFF | ON | OFF |
| | 12f | OFF | OFF | OFF | OFF | OFF | ON |
| OUTPUT SIGNAL | O1 | | O | O | O | O | |
| | O2 | | | O | O | O | O |
| | O3 | O | | | O | O | O |
| | O4 | O | O | | | O | O |
| | O5 | O | O | O | | | O |
| | O6 | O | O | O | O | | |
FIG. 12
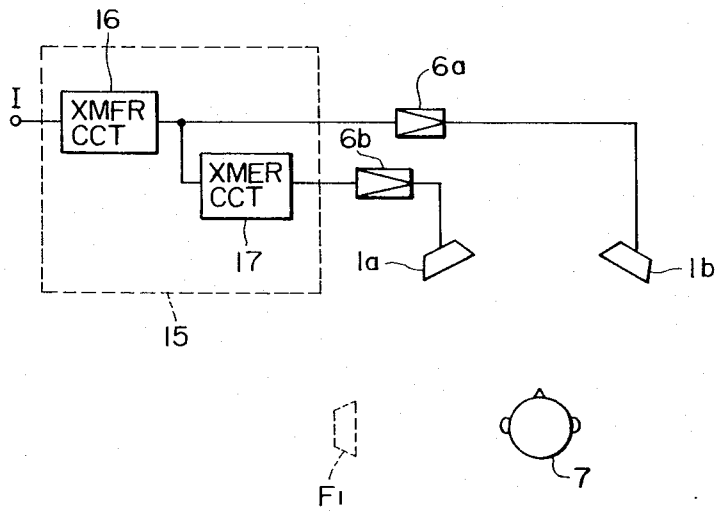
FIG. 13
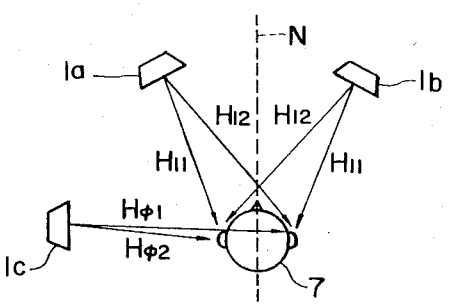

FIG. 28
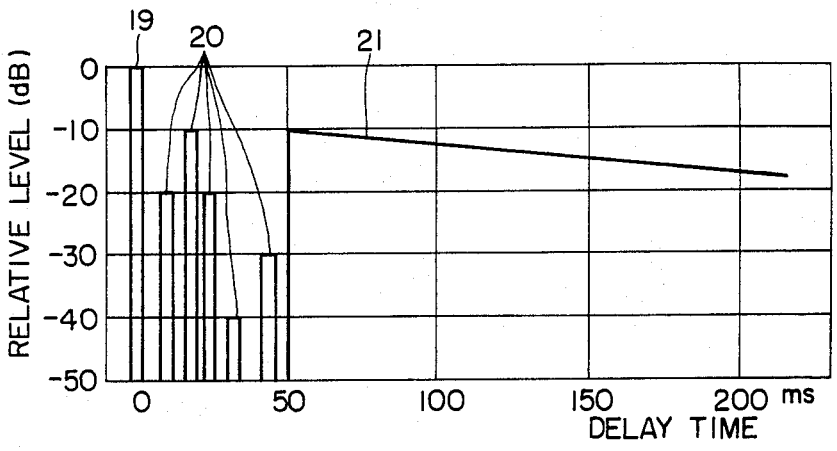
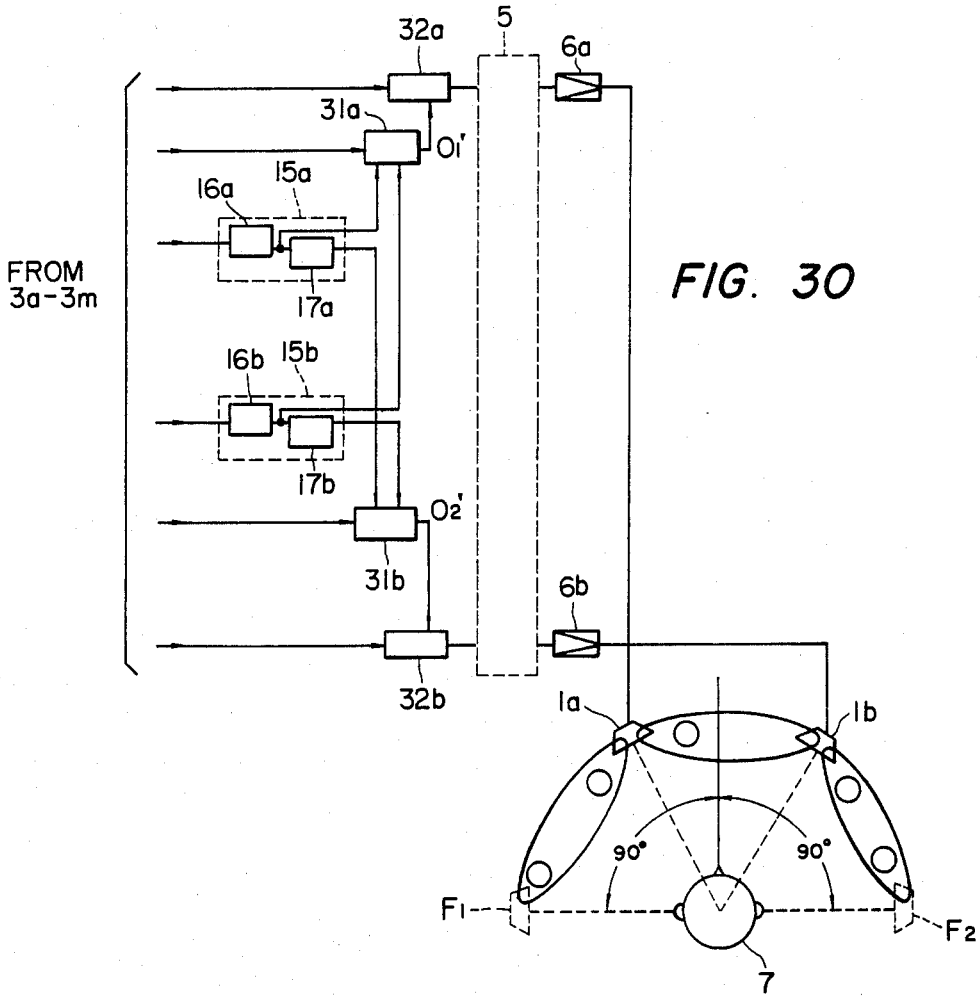
FIG. 30

SOUND REPRODUCTION SYSTEM HAVING SONIC IMAGE LOCALIZATION NETWORKS

BACKGROUND OF THE INVENTION

The present invention relates generally to sound reproducing systems, and in particular to a system for localizing sonic images in desired areas using two loudspeakers located in front of a listener.

In conventional multi-channel sound reproduction systems sonic images appear to originate in the area between two loudspeakers located in front of the listener. In stereophonic systems in which the signals carries information as to the direction and distance of sounds or sonic images with respect to the listener, the sonic images are localized so that they are made to appear to originate from a point determined by the information carried by the input stereophonic signals. Monophonic signals which carries no localization information can also be localized when applied to two loudspeakers at a desired position by varying the relative amplitude of the signals applied to the speakers to the other. However, the localized images are restricted to the area between the two speakers so that the listener hears sounds at the same distance, that is, the distance between the speakers and the listener. It is therefore desirable to localize sound at any point around the listener and to make the localized image move continuously in the sound reproduction field in response to a manual control regardless of whether the input audio signal is stereophonic or monophonic.

SUMMARY OF THE INVENTION

The present invention permits localization of sonic images whose angular position and distance to the listener is made variable by manually controlling the relative voltage levels of each channel signal to other channel signals. The invention contemplates to localize at least one sound source, either real or phantom, at 90 degrees to the normal to the listener in a sound reproducing field in which two loudspeakers are located in front of the listener. The localized real or phantom sound source and the front speakers are located symmetrically with respect to the listener.

In accordance with the invention, an input audio signal is divided into a plurality of channel signals which are applied respectively to a plurality of voltage adjusting elements, which is preferably a panoramic potentiometer. Two of the channel signals are applied respectively to the loudspeakers and the remainder is applied to an additional loudspeaker to generate the real sound source, or combined with the channel signals applied to the front speakers to generate the phantom sound source. By manually controlling the voltage adjusting elements, a sonic image is located in an area between the real or phantom sound source and one of the front loudspeakers as well as in the area between the front speakers. Preferably, two real or phantom sound sources are generated on both sides of the listener symmetrically with respect to the listener. If the signals used to generate such additional sound sources are of equal amplitude and in phase with each other, the variation of the channel signals applied to the front speakers in relation to the other channel signals permits the sonic image to be localized at a point away from the front speakers toward the listener, so that it is localized at any point within the front half plane of the listener. If additional ones of such real or phantom sources are located at the rear of the listener, it is possible to localize sonic images within the area of a full circle.

The realism of the original sound field can be enhanced by generating primary echo signals which are the reflections of a direct signal from the surrounding walls and by additionally generating reverberation signals. These indirect signals are generated at specified delay times and applied at relatively different voltage levels to localization networks, and combined with the direct signal and applied to the front loudspeakers. The system of the invention thus enables the listener to have the impression of an expanded stage width if the system is supplied with stereophonic signals.

BRIEF DESCRIPTION OF THE DRAWINGS

These and other features and advantages of the invention will become apparent from the following description with reference to the accompanying drawings in which:

FIG. 10 is a representation of the location of sonic image localized by the embodiment of FIG. 9 as a function of the operating states of switches and the relative voltage levels of channel signals;

FIGS. 12 and 13 are sketches useful for describing the transfer functions of the localization betworks of FIG. 11;

FIG. 28 is a graphic illustration of echos and reverberations which are generated by the system of FIG. 27 at relatively delayed times in response to a direct signal;

FIGS. 29 and 30 are illustrations of modified forms of the embodiment of FIG. 27;

DETAILED DESCRIPTION

Figure 1:
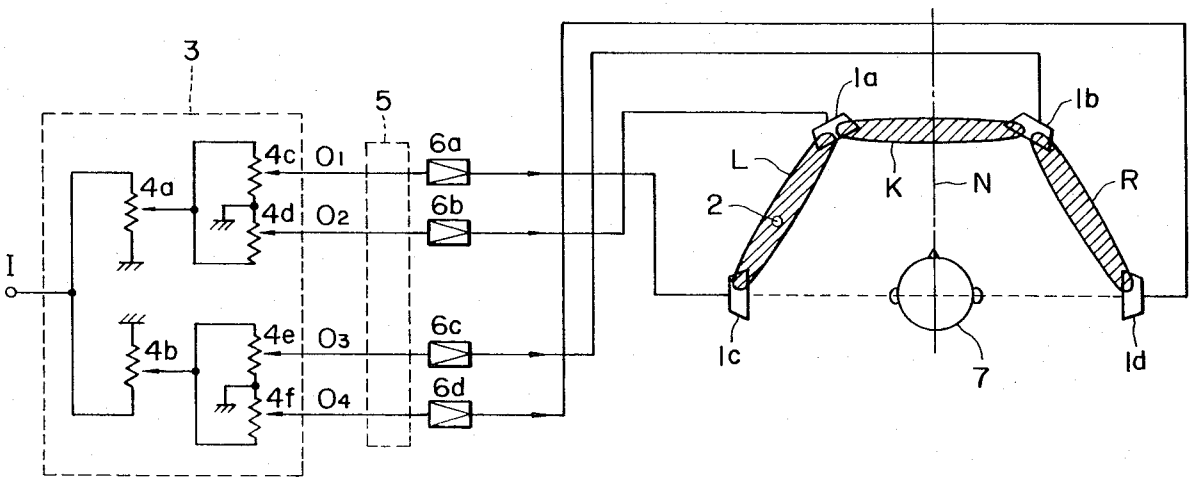
FIG. 1 is an illustration of a first embodiment of the present invention.
Figures 2, 3, 4:
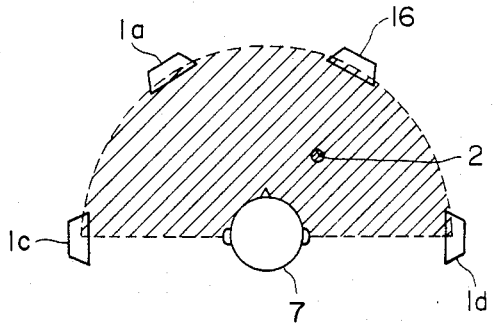
FIGS. 2 and 3 are representations of the location of localized sonic image as a function of the relative voltage levels of the channel signals useful for describing the operation of the embodiment of FIG. 1.
FIG. 4 is a sketch illustrating the area in which sonic images can be localized.

Referring now to FIG. 1 of the drawings, a first embodiment of the present invention is illustrated as comprising a panoramic potentiometer 3, a plurality of linear amplifiers 6*a* to 6*d*, and loudspeakers 1*a*, 1*b*, 1*c* and 1*d* connected respectively to the outputs of the amplifiers 6*a*, 6*b*, 6*c* and 6*d*. The panoramic potentiometer 3 comprises a pair of potentiometers 4*a* and 4*b* having one of their terminals connected to an input terminal I to divide a signal applied thereto into two signals and having their other terminals connected to ground to develop the divided signals at their wiper tap points. The potentiometer 3 further includes potentiometers 4*c*, 4*d*, 4*e* and 4*f*, the potentiometers 4*c* and 4*d* being connected together to the wiper tap point of the potentiometer 4*a* to divide the voltage developed thereat further into two output signals which appear at the wiper tap points of the potentiometers 4*c* and 4*d* and delivered to output terminals O1 and O2. The potentiometers 4*e* and 4*f* are of the similar construction to the potentiometers 4*c* and 4*d* and connected together to the wiper tap point of the potentiometer 4*b* to divide the voltage developed thereat further into two output signals which appear at output terminals O3 and O4. The panoramic potentiometer 3 includes a common joystick, not shown, which when manually operated causes a respective one of the wiper tap points of the internal potentiometers 4*a* to 4*f* to mcve across the associated resistance elements so that the voltage at one output terminal is varied in relation to the other output voltages. The signal applied to the input terminal I carries no information as to the localization of sonic images and such signals are available from a monaural signal source or one of the channels of a multi-channel stereophony. The voltage signals at output terminals O1 to O4 may be recorded into separate tracks of a recording medium of a recording system 5 rather than directly applied to the amplifiers 6*a* to 6*d*. The signal amplified at amplifiers 6*a*, 6*b*, 6*c* and 6*d* are respectively applied to loudspeakers 1*c*, 1*a*, 1*b* and 1*d*. The speakers 1*a* and 1*b* are located in front of and symmetrically with respect to a listener 7 and the speakers 1*c* and 1*d* are located at equal distances from the listener 7 at angular positions which are 90 degrees to the normal N to the listener 7. Preferably, the side speakers 1*c* and 1*d* are located at the same distances as the speakers 1*a* and 1*b* are located with respect to the listener 7. By operating the common joystick of the panoramic potentiometer 3 it is possible to localize a sonic image in an area between any two of the speakers 1*a* to 1*d*, so that the sonic image as indicated at 2 can be moved from an area L (between speakers 1*a* and 1*c* to an area K (between speakers 1*a* and 1*b*) and thence to an area R (between speakers 1*b* and 1*d*). FIG. 2 is an illustration of the relative voltage levels of the output signals O1, O2, O3 and O4 and the locations of the sonic image 2 in which the voltage levels are indicated by hatched area. In this Table the output signal O1 is shown to decrease from a maximum level to zero and the signal O2 is shown to increase from zero to a maximum with the signals O3 and O4 being adjusted to zero when the sonic image 2 is moved from the leftmost point of the area L to the rightmost point. By decreasing the level of signal O2 while increasing the signal O3 with the signals O1 and O4 being adjusted to zero, the sonic image 2 is moved from the leftmost point of the area K to its rightmost point. Likewise, with the signals O1 and O2 being adjusted to zero, a decrease in output signal O3 and an increase in output signal O4 causes the image 2 to move from the leftmost point of the area R to its rightmost point.

In this embodiment, if the signals applied to the side speakers 1*c* and 1*d* have equal voltage levels and in phase with each other, it is possible to localize the image 2 at a point exactly on the location of the listener 7 so that he is made to feel as if the sound is originated in his head. With the voltage levels of the signals O1 and O4 being adjusted to give the listener 7 the impression of sound originating from within his head, it is possible to locate the image 2 at a point intermediate the speaker 1*a* and the listener 7 by appropriately adjusting the level of the signal applied to the speaker 1*a* in relation to the level of the signals applied to the speakers 1*c* and 1*d*, so that the panoramic potentiometer 3 permits the sonic image 2 to move continuously from the speaker 1*a* to the listener 7 or from the latter to the former. FIG. 3 illustrates the relative voltage levels of the output signals O1 to O4 to permit localization of sound images between the speaker la and the listener 7 in which numeral A represents the distance between them and D represents the distance between the image 2 and the listener 7. It is, of course, possible to localize the image 2 at a point other than between the speaker la and the listener. For example, a variation of the voltage levels of the signals applied to speakers 1*a* and 1*b* relative to each other so that the image 2 is located between the speakers 1*a* and 1*b* will permit such sonic image to be relocated to any point closer to the listener 7 by readjusting the levels of the signals O2 and O3 for the speakers 1*a* and 1*b* in relation to the levels of the signals O1 and O4 for the speakers 1*c* and 1*d* which were used to establish localization of the sonic image in the listener's head. Therefore, the sonic image can be located at any point within a hatched area in FIG. 4.

Figures 5, 6:
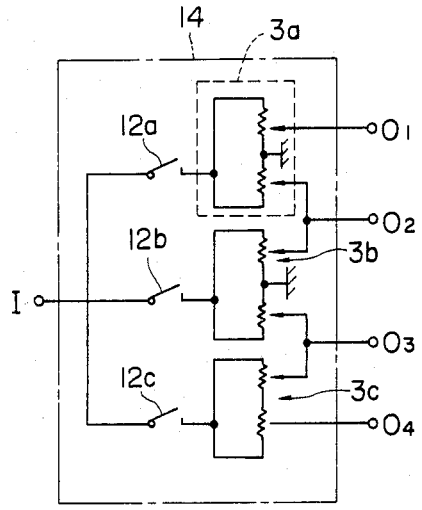
FIG. 5 is an illustration of an alternative form of the voltage adjusting device of FIG. 1.
FIG. 6 is a representation of the location of localized sonic image as a function of the relative voltage levels of the channel signals and the operating states of the switches of FIG. 5.

FIG. 5 is an illustration of an alternative form of the panoramic potentiometer 3. This potentiometer includes switches 12*a*, 12*b* and 12*c* which selectively connect the signal applied to the input terminal I into three signals for application to potentiometers 3*a*, 3*b* and 3*c* respectively. Each of the potentiometer arrangements 3*a* to 3*c* includes a pair of potentiometers connected together to the associated switch with the wiper tap points of adjacent potentiometers being connected together to the cutput terminals O2 and O3 and the remaining tap points being connected to output terminals O1 and O4. FIG. 6 illustrates the switching conditions of the switches 12*a* to 12*c* and the relative voltage levels of the output signals O1 to O4 for effecting localization of sonic images in the areas L, K and R.

Figure 7:
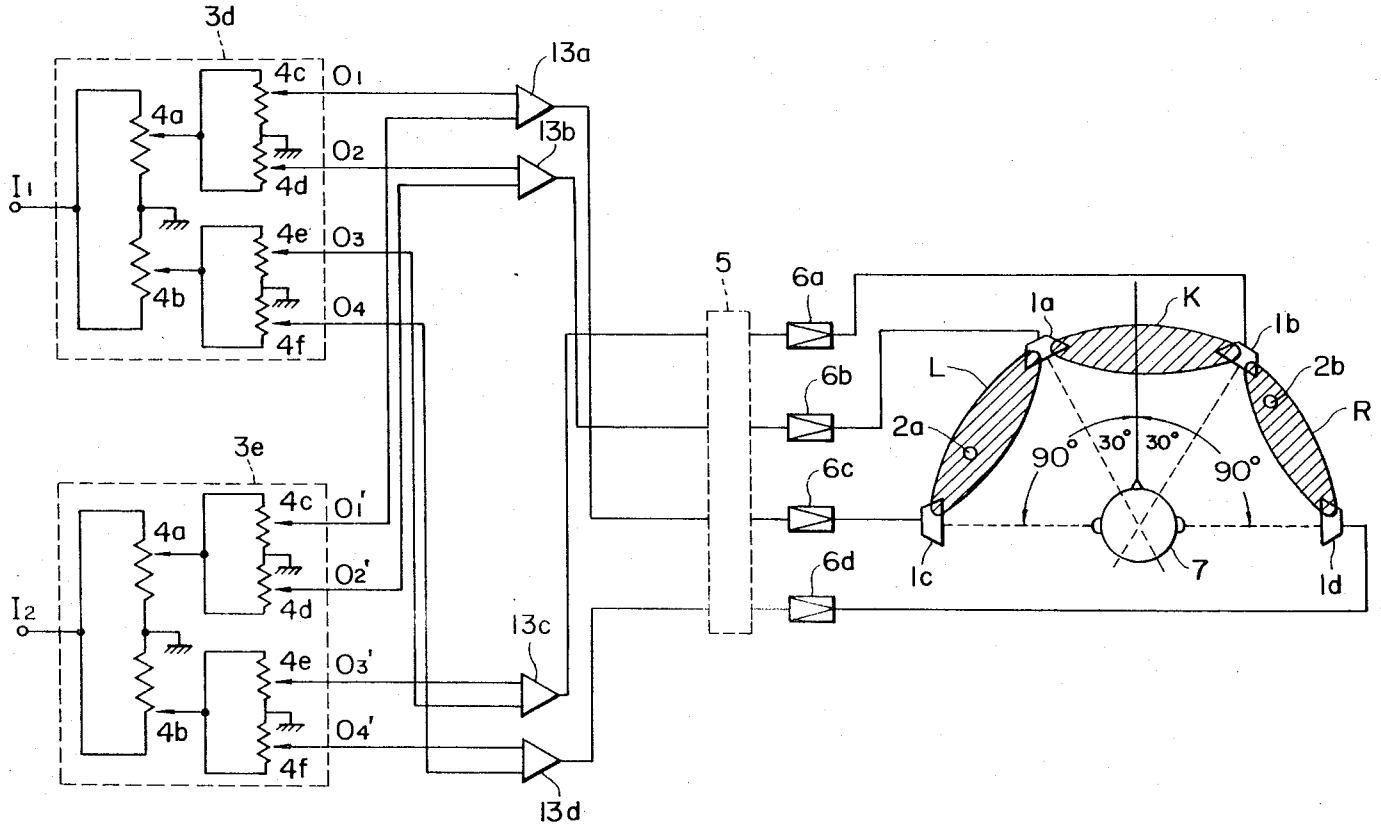
FIG. 7 is an illustration of a first modified form of the embodiment of FIG. 1

FIG. 7 is an illustration of a second embodiment of the present invention in which two signals are applied to input terminals I1 and I2. Each of these input signals carries no localization information. The system includes panoramic four-channel potentiometers 3*d* and 3*e* and adders 13*a*, 13*b*, 13*c* and 13*d*. Each of the four-channel panoramic potentiometers 3*d* and 3*e* is of the same construction as that shown in FIG. 1. The potentiometers 3*d* and 3*e* are connected to the input terminals I1 and I2, respectively, to divide the received input signals into a set of four output signals on leads O1 to O4 and leads O1' to O4', respectively. The signals on leads O1 and O1' are combined in the adder 13*a*, the signals on leads O2 and O2' being combined in the adder 13*b*. The outputs of the adders 13*a* and 13*b* are applied to the recording system 5 or directly to amplifiers 6*c* and 6*b* and thence to speakers 1*c* and 1*a* respectively to localize a sonic image 2*a* in the area L between these speakers. On the other hand, the signals on leads O3 and O3' are combined in the adder 13*c*, the signals O4 and O4' being combined in the adder 13*d*. The outputs of the adders 13*c* and 13*d* are applied to the recording system 5 or directly to amplifiers 6*a* and 6*d* respectively and thence to speakers 1*b* and 1*d* to effect localization of a sonic image 2*b* in the area R between these speakers. As described in the previous embodiment, the sonic images 2*a* and 2*b* can be independently localized at any desired point by independently adjusting the panoramic potentiometers 3*d* and 3*e* within the frontal half plane of a radius from the center point of the listener 7 to any one of the speakers 1*a* to 1*d* located at equal distances from the listener 7. The provision of a third panoramic potentiometer could also permit localization of an additional sonic image within the frontal half plane and permit movement of each localized sonic image continuously by moving the joysticks of the associated panoramic potentiometers.

Figure 8:
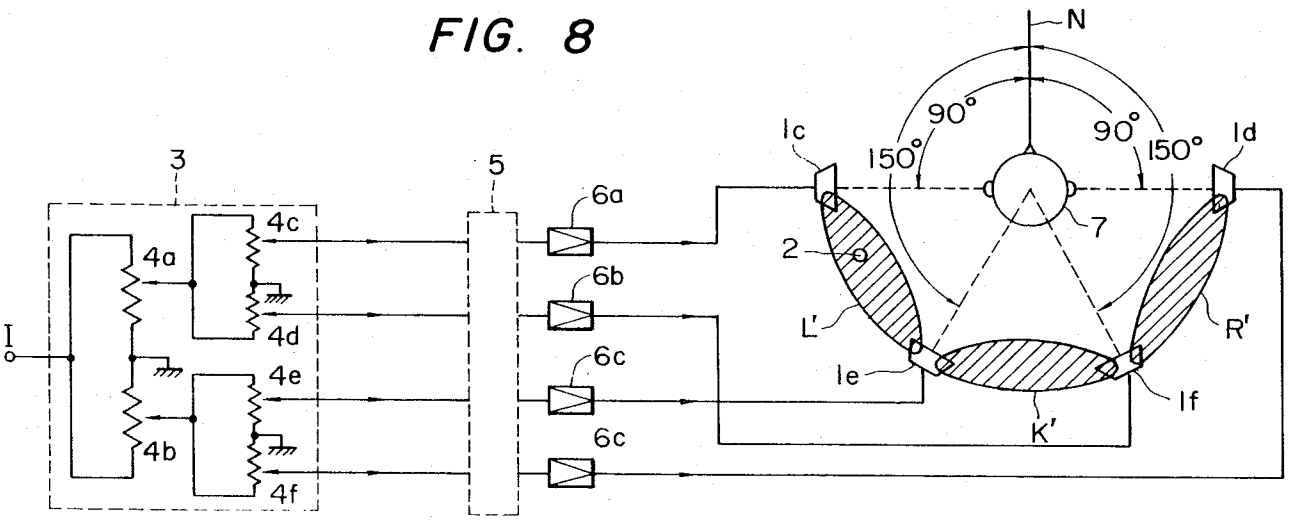
FIG. 8 is an illustration of a second modified form of the embodiment of FIG. 1.

The embodiment of FIG. 1 can be modified in a manner as illustrated in FIG. 8 which differs from the FIG. 1 embodiment in that the rear speakers 1*e* and 1*f* are used instead of the front speakers 1*a* and 1*b*. In this modified embodiment all the speakers are located symmetrically with respect to the listener 7. More specifically, the rear speakers are located at 150 degrees with respect to the normal N. A sonic image 2 is localized at any pcint within the area L' between speakers 1*c* and 1*e*, the area K' between speakers 1*e* and 1*f* and within the area R' between speakers 1*f* and 1*d*. A movement of the joystick of the potentiometer 3 could also result in a continuous movement of the localized image within the rear half plane with respect to the listener 7 in a manner as described in connection with FIG. 1.

Figure 9:
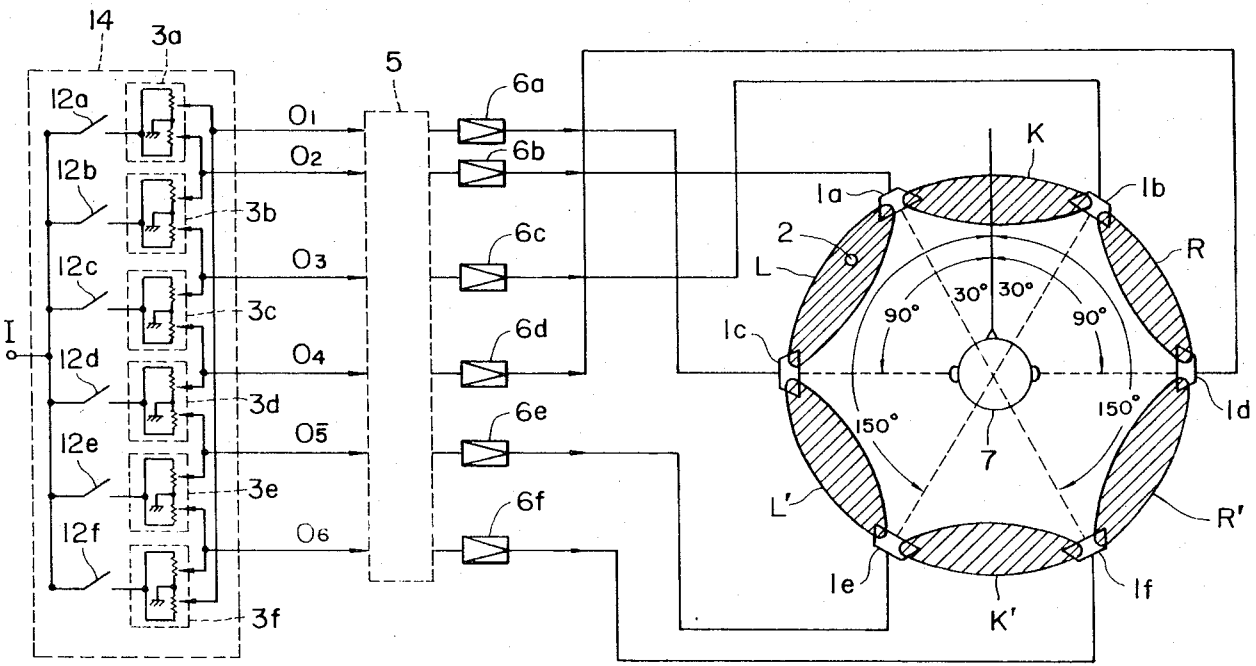
FIG. 9 is an illustration of a third modified form of the embodiment of FIG. 1.

FIG. 9 is an illustration of another embodiment of the invention in which the embodiments of FIGS. 1 and 8 are combined to localize sonic images within an area of a full circle with the listener being located at the center. In this embodiment, a voltage control device 14 comprises. a plurality of switches 12*a* to 12*f* connected in parallel with each other to the input terminal I and a plurality of 2-channel panoramic potentiometers 3*a* to 3*f* connected respectively the switches 12*a* to 12*f*. Each of the panoramic potentiometers includes two wiper terminals which are connected to the wiper termihals of adjacent panoramic potentiometers so that six output signals are delivered to leads O1 to O6 and thence to amplifiers 6*a* to 6*f* directly or via the recording system 5. There is a total of six speakers 1*a* to 1*f*, the speakers 1*a* and 1*b* being located in front of the listener 7 and the speakers 1*e* and 1*f* being at the rear and the speakers 1*c* and 1*d* being located sideways. All the speakers are arranged in a symmetrical relationship with respect to the listener. By operating the switches 12*a* to 12*f* and panoramic potentiometers 3*a* to 3*f*, sonic images can be localized within the hatched area. If the the signals applied to the speakers 1*c* and 1*d* are of equal amplitude and in phase with each other, the sonic images can be located at any point in the circle including the areas L, K, R, L', K' and R'. The operating stutus of the switches 12*a* to 12*f* and the relative levels of the output signals are illustrated in FIG. 10 to effect localization within the hatched areas L, K, R, R',K' and L'.

Figure 11:
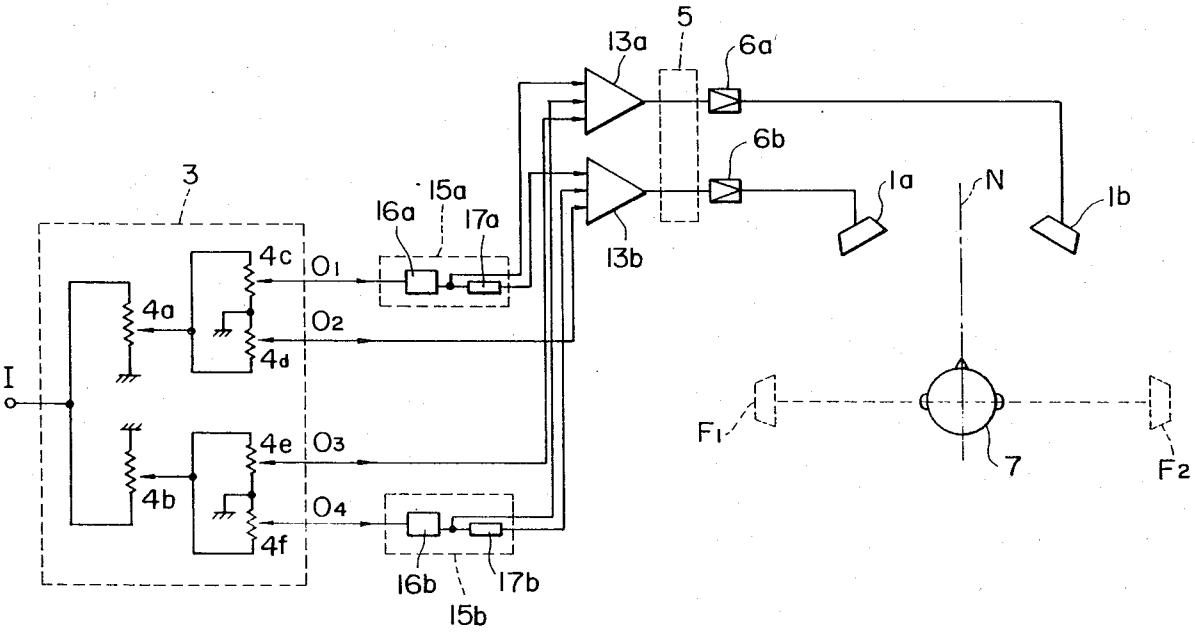
FIG. 11 is an illustration of a second embodiment of the present invention.

FIG. 11 is an illustration of a further embodiment of the invention in which localization networks are used to generate phantom sound sources or speakers rather than by the use of actual speakers in addition to the front speakers 1*a* and 1*b*. The embodiment of FIG. 11 differs from the FIG. 1 embodiment in that localization networks 15*a* and 15*b* are connected to the output terminals O1 and O4 of the 4-channel panoramic potentiometer 3. Each of the localization networks includes a first or common transfer circuit 16*a* (16*b*) and a second transfer circuit 17*a* (17*b*) which is connected to the output terminal of the common transfer circuit 16*a* (16*b*) Each localization network delivers a first output signal directly derived from the output of the common transfer circuit 16 and a second output signal which is derived from the output of the second transfer circuit 17. An adder 13*a* combines the first output signals from the localization networks 15*a* and 15*b* and the output signal on terminal O3, and an adder 13*b* combines the second output signals from the localization networks 15*a* and 15*b* and the output signal on terminal O2. The combined outputs from the adders 13*a* and 13*b* are applied to amplifiers 6*a* and 6*b*, respectively, directly or via the recording system 5, and thence to front speakers 1*a* and 1*b*. The details of the localization networks will now be explained with reference to FIGS. 12 and 13. In FIG. 12 the outputs of the localization network 15 are assumed to be connected to front speakers 1*a* and 1*b* via amplifiers 6*a*, 6*b*. In FIG. 13 acoustic paths from the front left speaker 1*a* to the listener's left and right ears have different acoustic transfer functions represented by $H_{11}$ and $H_{12}$, respectively, and acoustic paths from the front right speaker 1*b* to the listener's left and right ears are designated by $H_{12}$ and $H_{11}$, respectively. $H_{\phi'}$ *and* $H\phi 2$ designate the acoustic transfer functions between an actual sound source or speaker 1*c* (located at right angles to the normal N to the listener 7) to the listener's right and left ears, respectively. If front speakers are driven by signals which would produce the same sound pressures at the listener's ears as those created by sound waves transmitted from the front speakers 1*a* and 1*b*, then the listener 7 would have the impression that the sound is coming from the speaker 1*c* rather than from the front speakers 1*a* and 1*b*. To create a phantom sound source $F_1$ in the two-speaker system of FIG. 12 the common transfer circuit 16 is designed to have the transfer function $H_{\phi 1}/H_{11}$ and the second transfer circuit 17 is designed to have the following transfer function:

$$\frac{H_{11}H_{\phi 2} - H_{12}H_{\phi 1}}{H_{11}H_{\phi 1} - H_{12}H_{\phi 2}}$$

This phantom sound source $F_1$ is located exactly in the position of the actual speaker 1*c* in the arrangement of FIG. 13. It is to be noted that by appropriately selecting the parameters of the transfer functions of the first and second transfer circuits 16 and 17 the phantom sound source may be located at any point around the listener 7. It is therefore possible to generate phantom sound sources $F_1$ and $F_2$ in the arrangement of FIG. 11 at 90 degrees to the normal N to the listener 7 by appropriately selecting the parameters of the transfer circuits of the localization networks 15*a* and 15*b*. As described in connection with the embodiments of FIG. 1 sonic images can be located at any point in the front half plane defined by the actual speakers 1*a* and 1*b* and phantom sound sources $F_1$ and $F_2$.

Figure 14:
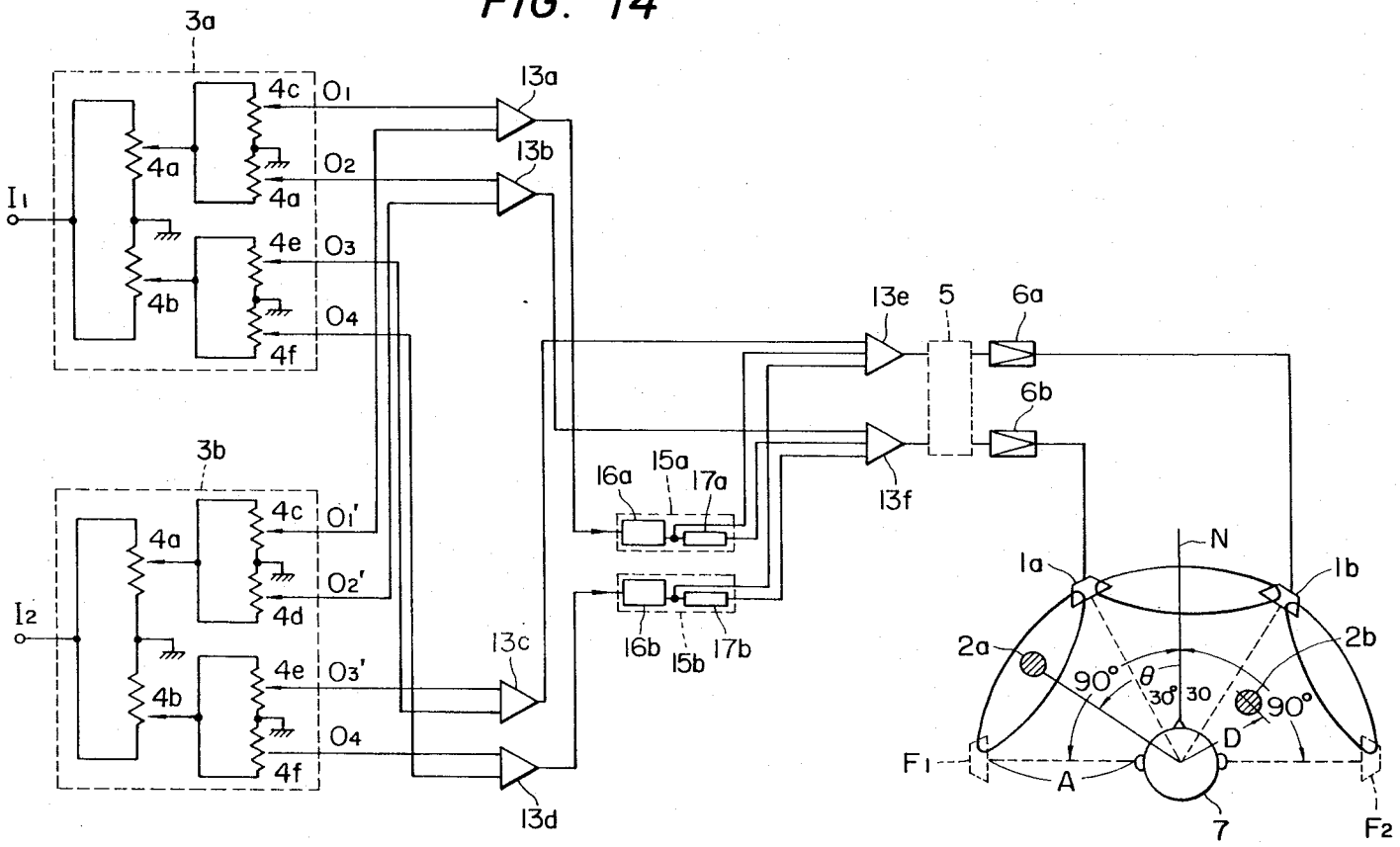
FIG. 14 is an illustration of a first modified form of the embodiment of FIG. 11.

FIG. 14 illustrates a modified embodiment of FIG. 11 in which two input signals are applied to terminals $I_1$ and $I_2$ in a manner similar to that shown in FIG. 7 with the exception that the localization networks 15*a* and 15*b* employed in the FIG. 11 embodiment are used to generate phantom sound sources in a two-speaker sound field. In this embodiment the adders 13*a* to 13*d* each combine the output signals of the four-channel panoramic potentiometers 3*a* and 3*b* in the same manner as in the FIG. 7 embodiment but differ therefrom in that they deliver their output signals to adders 13*e* and 13*f* from adders 13*b* and 13*c*, respectively, and to localization networks 15*a* and 15*b* from adders 13*a* and 13*d* and thence to the adders 13*e* and 13*f*. The outputs of the adders 13*a* and 13*f* are respectively applied via amplifiers 6*a* and 6*b* to the front speakers 1*b* and 1*a*. Sonic images 2*a* and 2*b* are individually located at any points within the front half plane by operating the potentiometers 3*a* and 3*b*. As previously decribed this embodiment also permits localization of any number of sonic images by the provision of a desired number of panoramic potentiometers.

Figure 15:
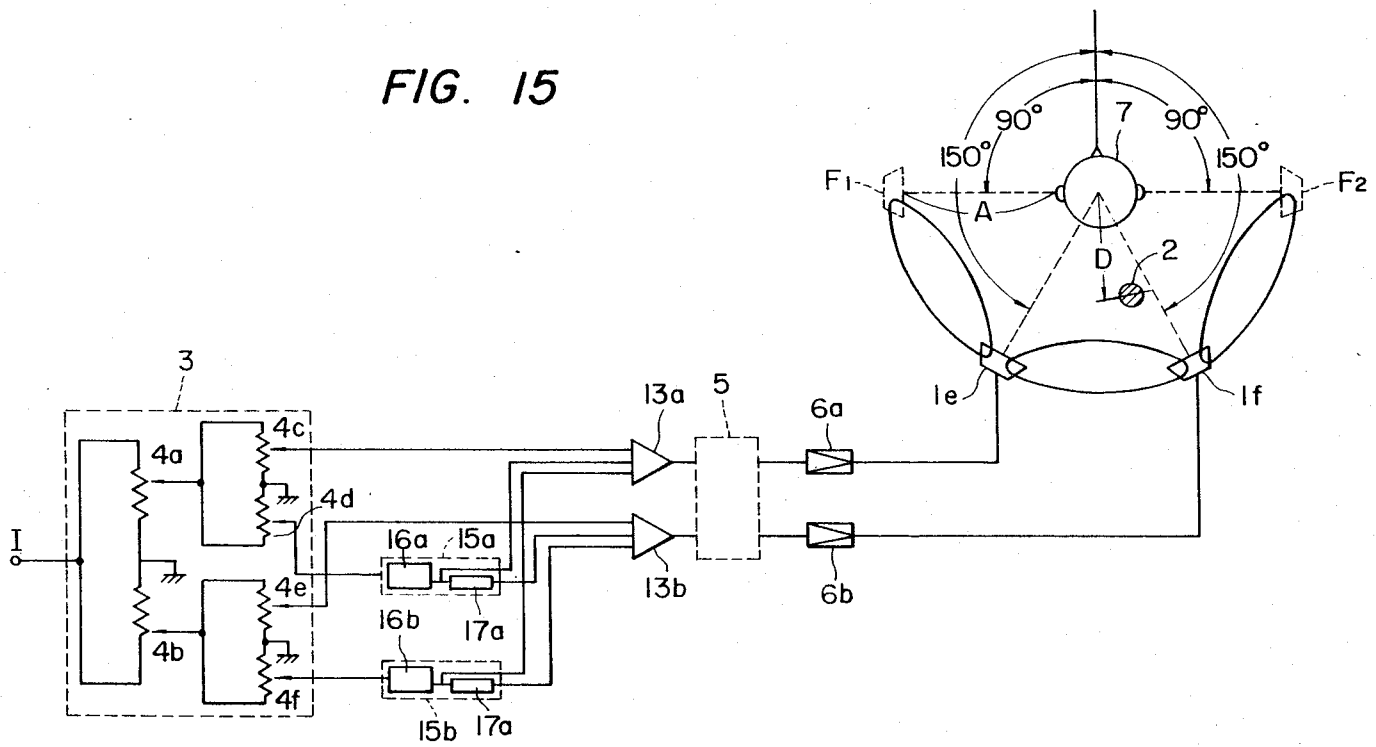
FIG. 15 is an illustration of a second modified form of the embodiment of FIG. 11.

Localization networks can also permit localization behind the listener by arranging speakers at the rear of the listener as illustrated in FIG. 15.

Figure 16:
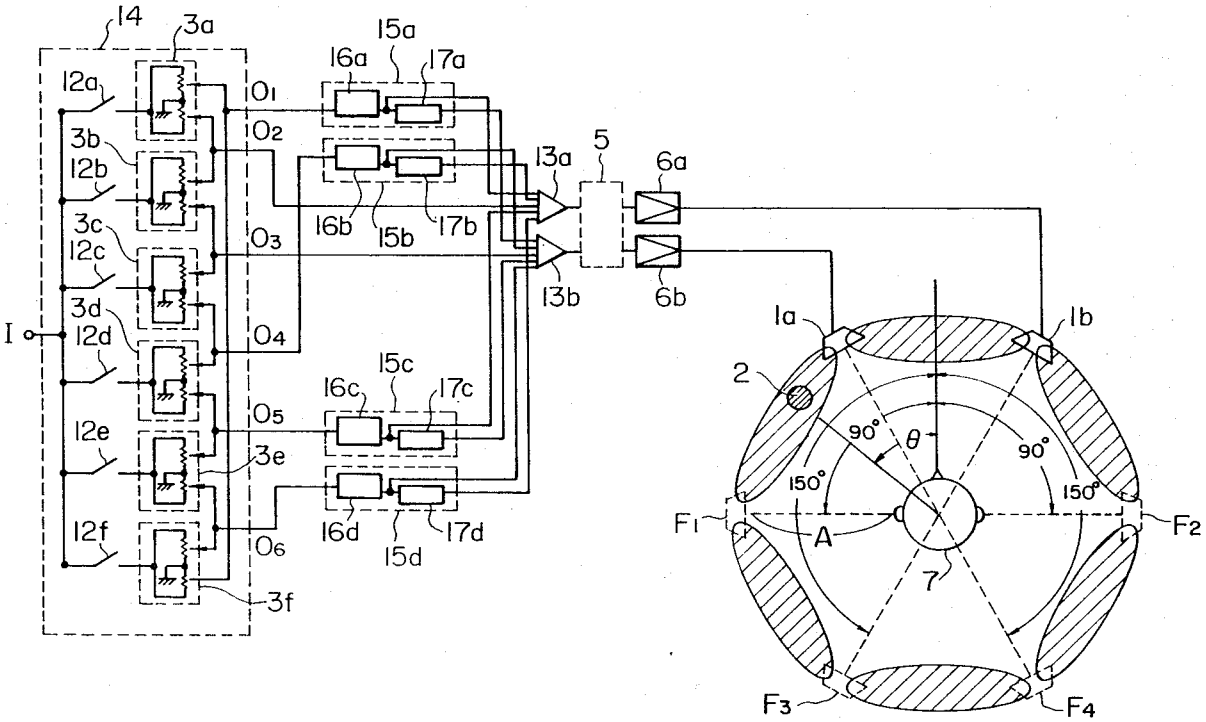
FIG. 16 is an illustration of a third modified form of the embodiment of FIG. 11.

Localization networks may also be used to generate more than two phantom sound sources. An embodiment shown in FIG. 16 is intended to generate four phantom sound sources $F_1$ to $F_4$. A voltage control device 14, as used in FIG. 9, receives a single channel signal at terminal I and delivers six output signals on leads O1 to O6. The signals on leads O2 and O3 are directly applied to adders 13*a* and 13*b*, respectively, the signals on leads O1 and O4 being applied to localization networks 15*a* and 15*b*, and the signals on leads O5 and O6 being applied to localization networks 15*c* and 15*d* respectively. The adder 13*a* combines the signal from lead O2 with outputs from localization networks 15*a*, 15*b*, 15*c* and 15*d*, and the adder 13*b* combines the signal from the lead O3 with output signals from the localization networks 15*a* to 15*d*. The outputs of the adders 13*a* and 13*b* are applied via amplifiers 6*a* and 6*b* and thence to front speakers 1*b* and 1*a*, respectively. By appropriately designing the localization networks 15*a* to 15*d* the phantom sound sources $F_1$, $F_2$, $F_3$ and $F_4$ are located symmetrically with respect to the listener 7 at 60-degree intervals. By manipulating the switches 12*a* to 12*f* and panoramic potentiometers 3*a* to 3*f* it is possible to localize sonic images at any point within the area of a full circle.

Figure 17:
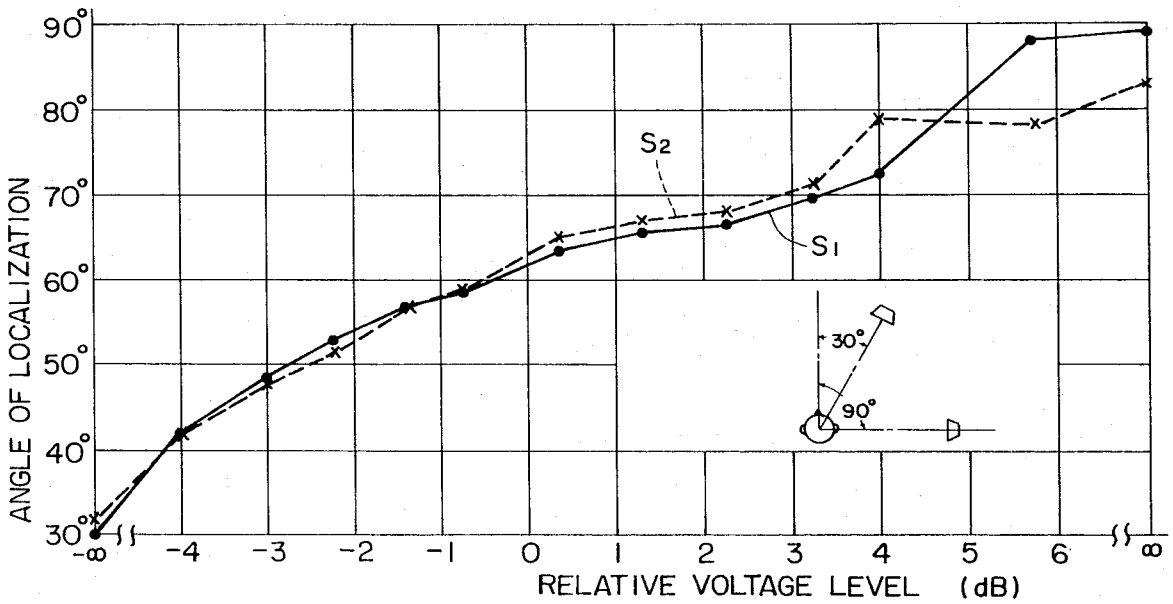
FIGS. 17 to 20 are illustrations of the results of psycho-acoustical verification tests conducted on the systems of the invention.

FIG. 17 is a graphic illustration of psycho-acoustical verification tests for the purpose of verifying the localization of sonic images creatd by actual and phantom sound sources which are located at 30 and 90 degrees to the normal to a listener. The tests involved 10 subjects who were seated in the respective sound fields to record the direction in which they perceived that the sound is coming. In FIG. 17 the ratio of the signal level of one of the sound sources to that of the other is indicated on the abscissa and the angular position of the localized image is indicated on the ordinate. A solid-line curve $S_1$ is a plot of averaged values of angular orientations recorded with the actual speaker system and a broken-line curve $S_2$ is a plot of the corresponding data obtained from the phantom speaker system. Curves $S_1$ and $S_2$ verify that the sound is made to appear to originate from the intended angular positions.

Figure 18:
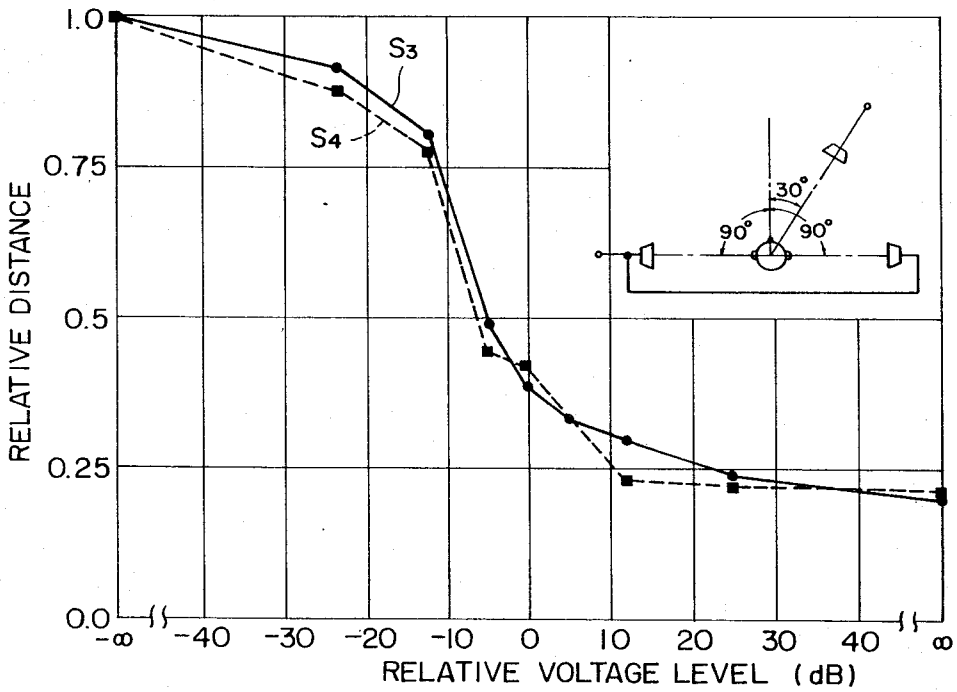

FIG. 18 illustrates other verification tests in which the subjects were seated in an actual and a phantom sound field in each of which sound sources are located at three positions, one at 30 degrees to the normal to the listener and the other suces being at ±90 degrees to the normal. On the abscissa is indicated the ratio of the signal applied to the front speaker to those applied to other speakers and on the ordinate is indicated the relative distance to the localized sonic image which the subjects perceived at a given signal ratio. A solid-line curve $S_3$ is a plot obtained from the actual sound field and a broken-line curve $S_4$ is a plot obtained from the phantom sound field in which only the front source is an actual sound source. Both curves verify that the distance to the localixed images is clearly perceived by the listeners in respect of both phantom and actual sound fields.

Figure 19:
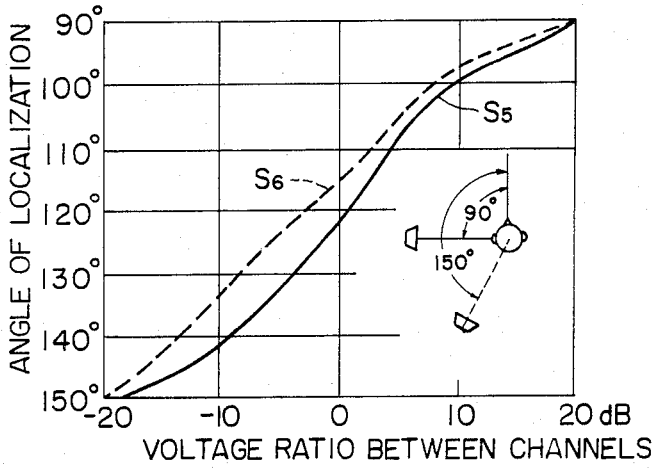
Figure 20:
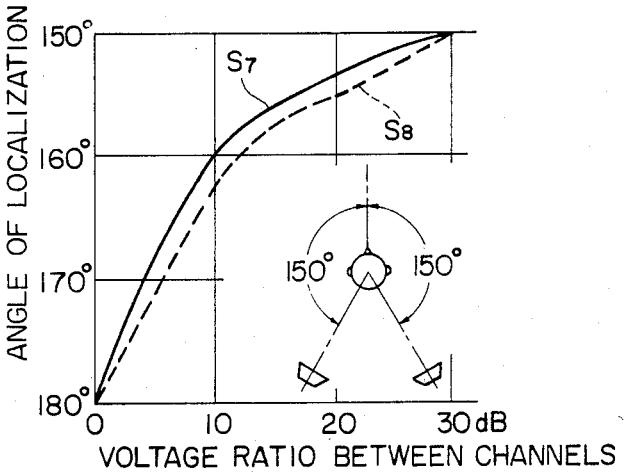

Verification tests were further conducted with respect to a speaker arrangement in which sound sources are located in two positions, one at 90 degrees to the normal to the listener and the other at 150 degrees to the normal. In FIG. 19 curves $S_5$ and $S_6$ are plots obtained respectively from actual and phantom sound fields in each of which sound sources are located in 90- and 150-degree positions with respect to the normal. IN FIG. 20, curves $S_7$ and $S_8$ are plots obtained respectively from actual and phantom sound fields in each of which sound sources are locatred at the reat of the listener (±150 degrees to the normal). These tests verify that the system of the invention is capable of providing localization of sound images in clearly distinguishable angular orientations.

Since the panoramic potentiometer is designed to establish voltage levels of the output signals in a predetermined variable ratio as a function of movement of the joystick, it is impossible to vary the distance from one localized sonic image to the listener in relation to the distance from another localized sonic image to the listener regardless of the ratio established by the panoramic potentiometer. This is accomplished by the provision of one or more attenuators in the input circuits of one or more speakers but smaller in number than the total number of the speakers.

Figure 21:
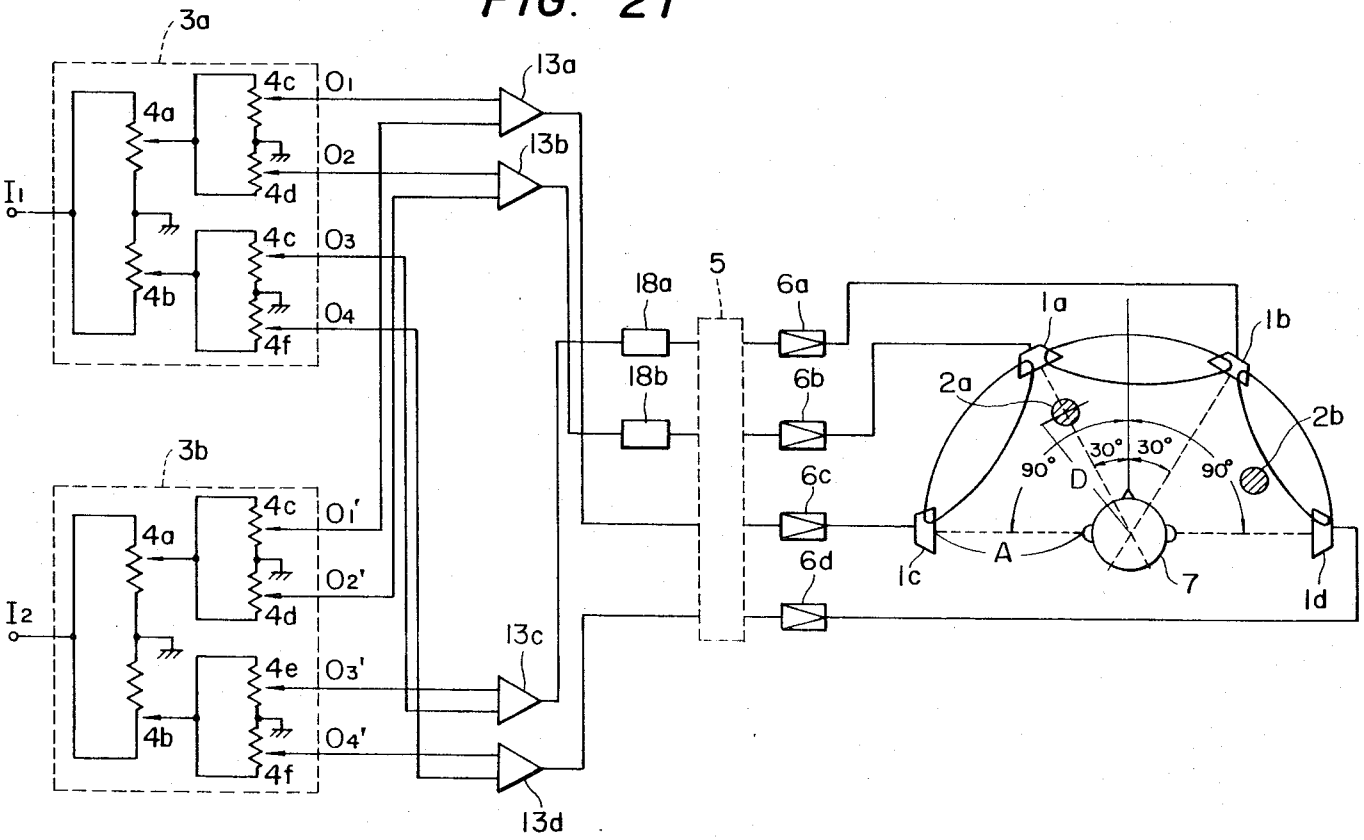
FIGS. 21, 22, 23, 24, 25 and 26 are illustrations of modified forms of the embodiments of FIGS. 7, 8, 9, 14, and 16, respectively.
Figure 22:
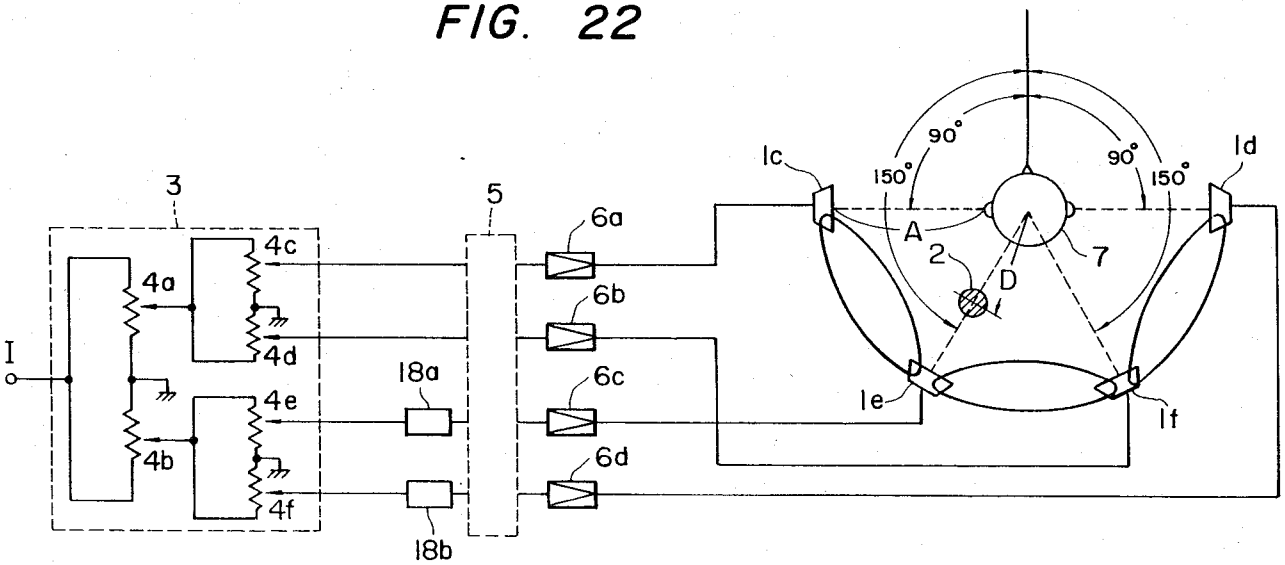
Figure 23:
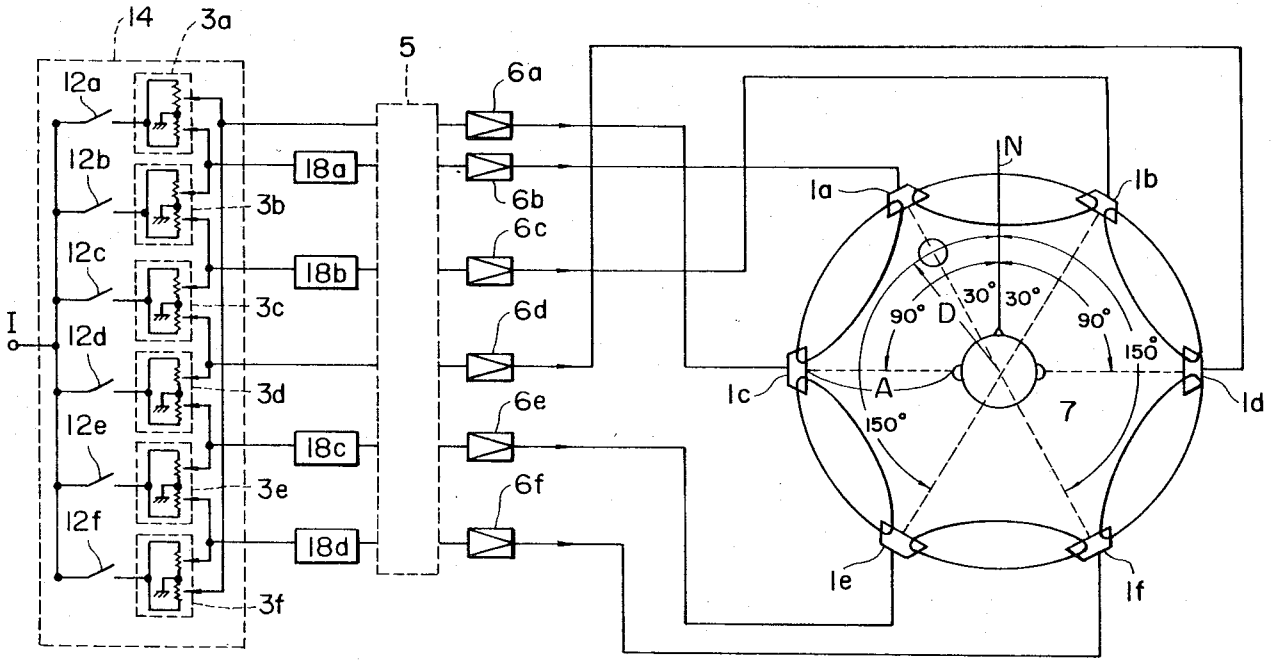
Figure 24:
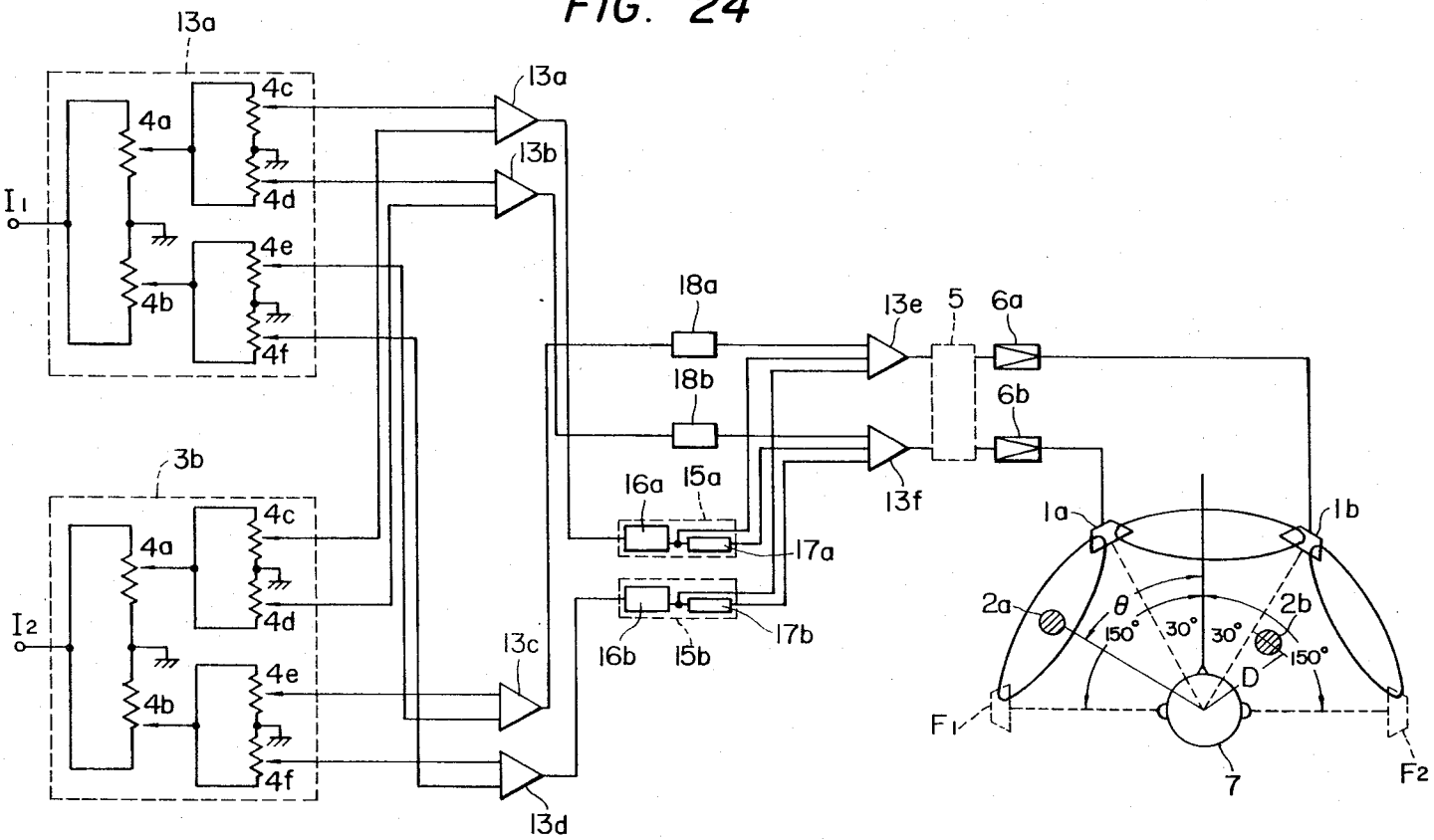
Figure 25:
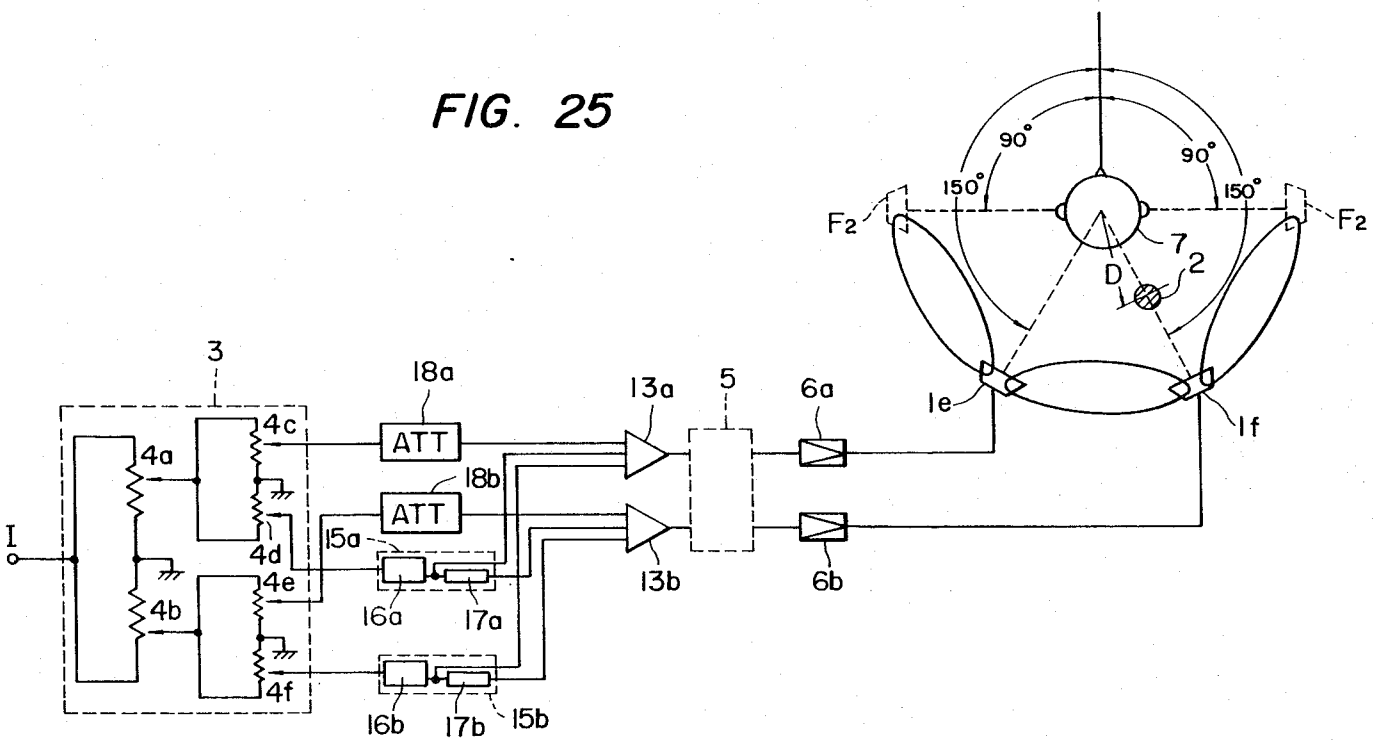
Figure 26:
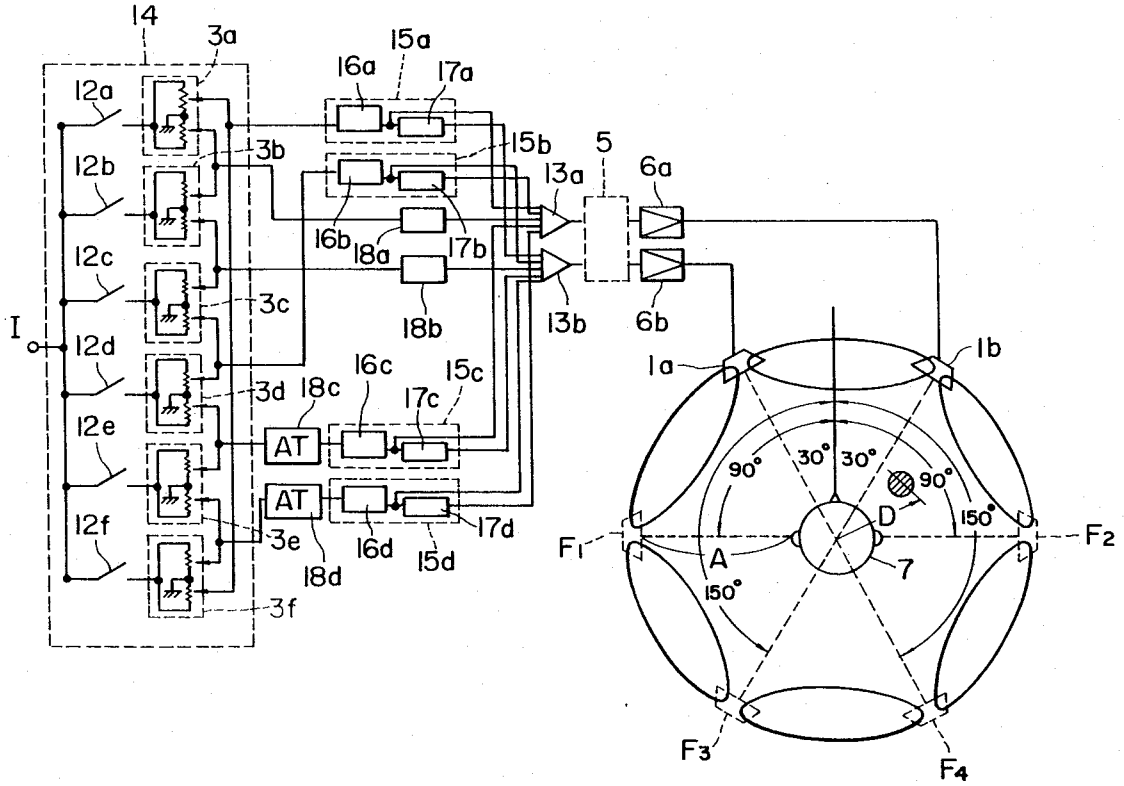

To this end, the embodiments of FIGS. 7, 8, 9, 14, 15 and 16 are modified as shown in FIGS. 21 to 26, respectively. In FIG. 21, attenuators 18*a* and 18*b* are connected between the outputs of adders 13*c*, 13*b* and the inputs of the amplifiers 6*a*, 6*b*, respectively, to localize a sonic image 2*a* at a particular distance D from the listener within the radius A (between the center of listener 7 and the speakers 1*a* to 1*c*) in relation to the distance from another sonic image 2*b* to the listener. One of the attenuators 18*a* and 18*b* can be dispensed with. In FIG. 22, the attenuators 18*a* and 18*b* are connected in the input circuits of the amplifiers 6*c* and 6*d* to modify the levels of the signals to the rear speaker 1*e* and to the right side speaker 1*d*; whereby the sonic image 2 can be located a distance D from the listener independently of the adjustment of the panoramic potentiometer 3. In the system of FIG. 23, which is a modification of the FIG. 9 embodiment, attenuators 18*a*, 18*b*, 18*c* and 18*d* are connected in the input circuits to the amplifiers 6*b*, 6*c*, 6*e* and 6*f*, respectively to alter the levels of signals applied to the front speakers 1*a* and 1*b* and the levels of signals applied to the rear speakers 1*e* and 1*f* in relation to the levels of signals applied to side speakers 1*c* and 1*d*. In FIG. 24, which is a modification of the FIG. 14 embodiment, attenuator 18*a* is connected between the output of adder 13*c* and an input of the adder 13*e*, and attenuator 13*b* is connected in the circuit between the adders 13*b* and 13*f*. In FIG. 25, which is a modification of the FIG. 15 embodiment, attenuator 18*a* is connected in the circuit between potentiometer 4*c* and adder 13*a* and attenuator 13*b* is connected in the circuit between potentiometer 4*e* and adder 13*b*. In FIG. 16, which is a modification of the FIG. 16 embodiment, attenuator 18*a* is connected in the circuit between the common output of potentiometers 3*a*, 3*b* and adder 13*a* and attenuator 18*b* is connected in the circuit between the common output of potentiometers 3*b*, 3*c* and adder 13*b*.

Figure 27:
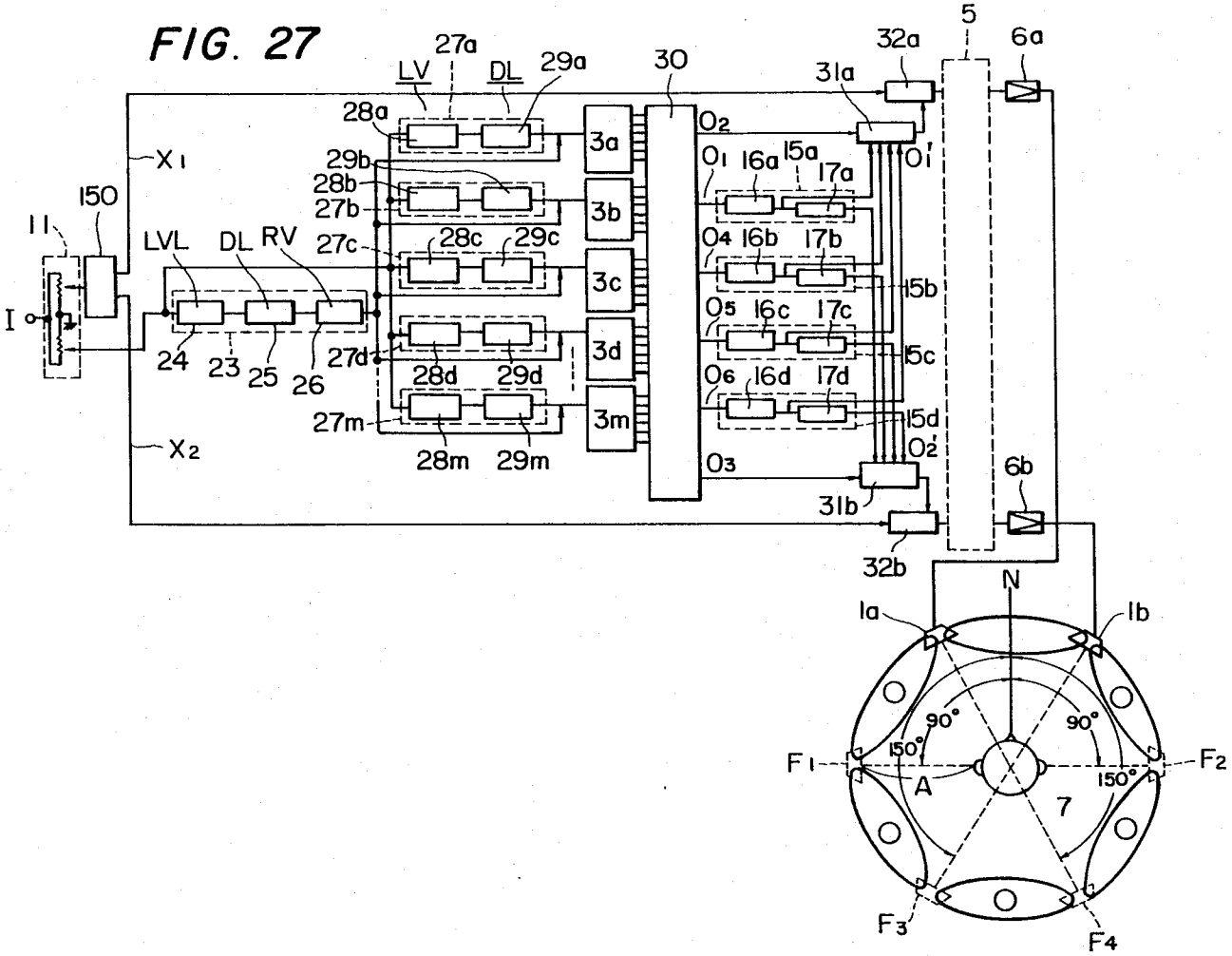
FIG. 27 is an illustration of a third embodiment of the invention in which primary echos and reverberations are generated in the sound field in addition to the direct signal.

The sound reproducing system of the present invention is further modified as shown in FIG. 27 which produces reverberation in the sound field to enhance the realism of the original sound field. The system of FIG. 27 comprises a level adjusting device or two-channel panoramic potentiometer 11 which divides an input signal applied to terminal I into two-level-proportioned output signals one of which is applied to a localization network 150 of the construction identical to those described in the previous embodiments and the other of which is applied to a reverberation generator 23. The reverberation generator circuit 23 comprises a level adjusting device 24, a delay circuit 25 and a reverberation generator 26 all of which are connected in a series circuit which in turn is connected to the outputs of a plurality of primary echo generators 27*a* to 27*m*, or an m-channel echo generator. Each of the primary echo generators comprises a level adjusting device 28 and a delay circuit 29 connected in a series circuit the.input of which is connected to the input of the reverberation generator circuit 23 in common with other primary echo generators and the output of which is connected individually to a respective one of a plurality of 6-channel panoramic potentiometers 3*a* to 3*m*. An adder stage 30 is provided to combine the corresponding outputs of the panoramic potentiometers 3*a* to 3*m* to derive 6 output signals O1 to O6. The signals O2 and O3 are coupled respectively to adders 31*a* and 31*b*, while the signals O1, O4, O5 and O6 are coupled to localization networks 15*a*, 15*b*, 15*c* and 15*d*, respectively. The first localizing output of each network 15 is applied to the adder 31*a* and the second localizing signal of each network is applied to the adder 31*b*. The localization networks 15*a* and 15*b* are designed so that phantom sound sources are generated at ±90 degrees to the normal to the listener, while the localization networks 15*c* and 15*d* are designed so that phantom sound sources are generated at ±150 degrees to the normal.

A combined output signal O1' from the adder 31*a* is applied to an adder 32*a* which combines it with a first localizing signal X1 from the localization network 150. A combined signal O2' from the adder 31*b* is applied to an adder 32*b* where it is combined with a second localizing signal X2 from the localization network 150. The outputs of the adders 32*a* and 32*b* are applied directly to amplifiers 6*a* and 6*b* respectively (or via a recording system 5) and thence to front left speaker 1*a* and front right speaker 1*b* to generate a reproduction sound field in which phantom sound sources F1 and F2 are generated at ±90 degrees to the normal to the listener 7 and phantom sound sources F3 and F4 are generated at ±150 degrees to the normal.

The input signal applied to the terminal I is a signal which is directly received by a microphone in contrast with an indirect signal which is received by the microphone by the reflection of the direct signal from the surrounding walls. By application of such direct signal to the input terminal of the system, the signals applied to the speakers 1*a* and 1*b* contains the direct and indirect components of the input signal. The indirect components of the sighals applied to the speakers are generated by the reverberation generator circuit 23 whose amplitude relative to the direct component is adjusted by the level adjusting device 24 and whose time of occurrence relative to the time of occurrence of the direct component in the sound reproduction field is determined by the delay circuit 25. A typical value of the delay time introduced by the delay circuit 25 is 50 milliseconds. The indirect components of the signal further include primary echo signals generatd by the echo generators 27*a* to 27*m*. The amplitude of each echo signal relative to other echo signals is adjusted by the level adjusting device 28 and the time of occurrence of each echo relative to the direct component is determined by the delay circuit 29. FIG. 28 illustrates the relative amplitude of the direct and indirect components of the input signal and their times of occurrence in the sound field in which numerals 19, 20 and 21 respectively indicate the direct signal, primary echo signals and the reverberation. As illustrated in FIG. 28, the delay times introduced by the delay circuits 29*a* to 29*m* range from 10 to 50 milliseconds. Since the indirect components are passed through the localization networks 15*a* to 15*d* and combined with the localized direct signals in the adders 32*a* and 32*b*, the listener 7 hears localized direct component and localized echos and reverberations so that he has the impression that such primary echos come from various sources with the reverberating sounds coming in all directions from the distance.

Figure 29:
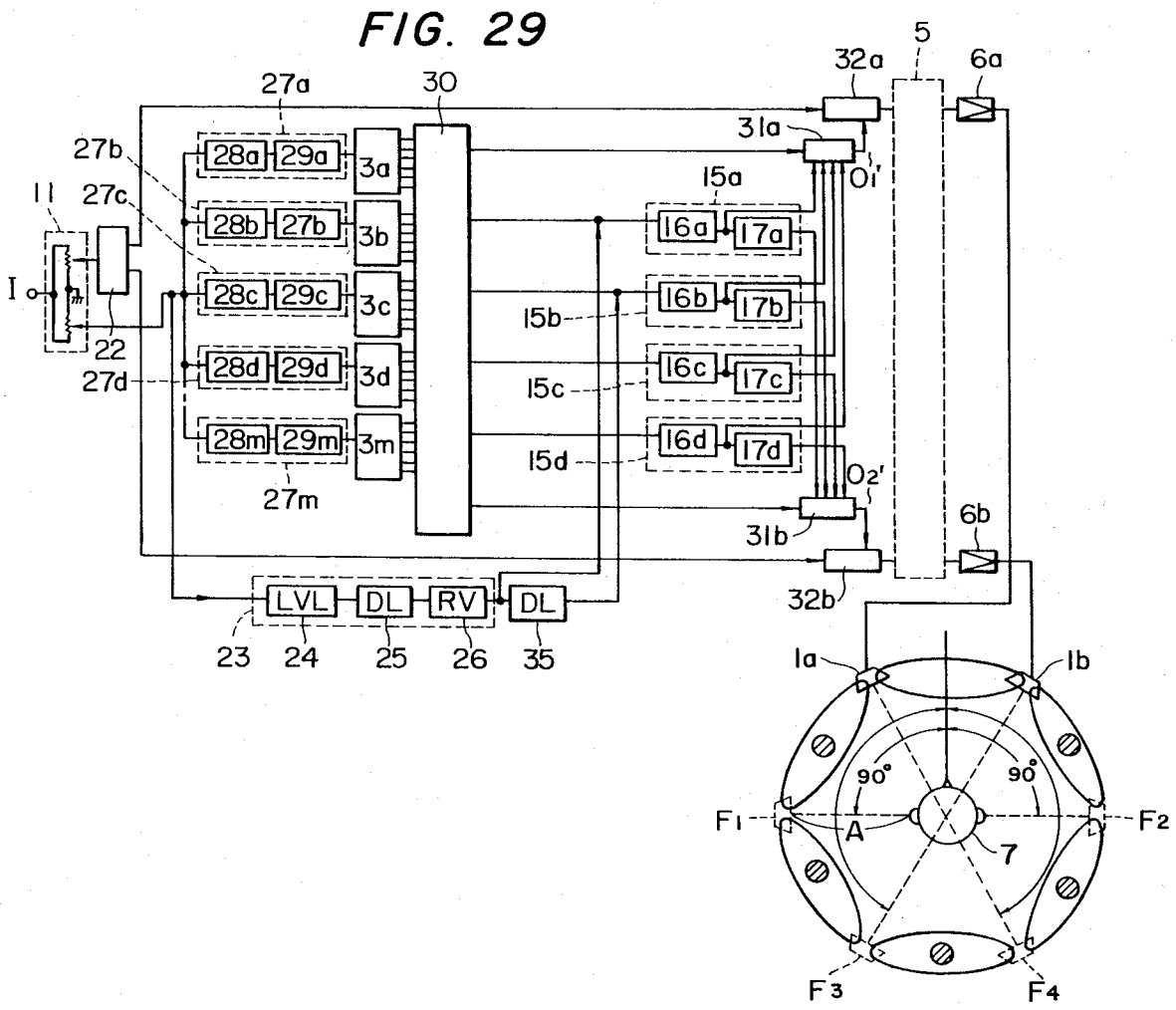

The embodiment of FIG. 27 can be modified as shown in FIG. 29 in which the output of the reverberation generator circuit 23 is branched into two component one of which is directly applied to the input of the 90-degree localization network 15*a* and the other of which is applied through a delay circuit or phase inverter 35 to the input of the −90-degree localization network 15*b*. Therefore, reverberations are made to appear to originate from the phantom sources F1 and F2. This embodiment serves to give the sense of an expanded field of reverberating sounds.

The embodiments of FIGS. 27 and 29 can be modified to localize the indirect signals at ±90 degrees to the normal to the listener 7 as illustrated in FIG. 30 by eliminating the 150-degree localization networks 15*c* and 15*d* from the previous embodiments, whereby the listener 7 hears indirect sounds as if they are coming from sources located in the front half plane.

Figure 31:
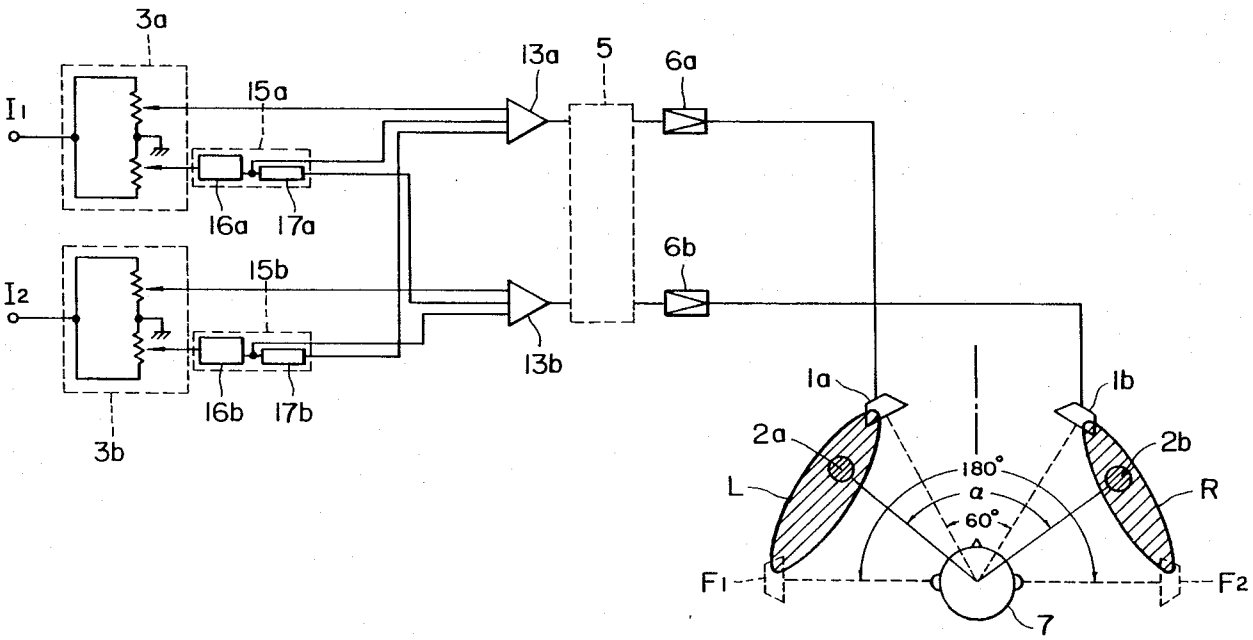
FIG. 31 is an illustration of a fourth embodiment of the invention which enables stereophonic signals to be localized in an expanded stage width.

The present invention can be further modified to give the impression of an expanded stage width by the use of the localization networks as previously described by making them process stereophonic signals, the signals carrying localization information. This is accomplished by an embodiment shown in FIG. 31. In this embodiment, 2-channel stereophonic signals are applied respectively to input terminals I1 and I2 and thence to 2-channel panoramic potentiometers 3*a* and 3*b*, respectively. One of the outputs of the potentiometer 3*a* is coupled to adder 13*a* and the other output is coupled to +90-degree localization network 15*a* where the signal is processed to derive two localized signals, one of which is applied to the adder 13*a* and the other of which is applied to adder 13*b*. Similarly, one of the outputs of the potentiometer 3*b* is applied to the adder 13*b* and the other output is applied to a −90-degree localization network 15*b*. One of the localized outputs of the network 15*b* is applied to the adder 13*b* and the other output is applied to the adder 13*a*. The outputs of the adders 13*a*, 13*b* are fed to amplifiers 6*a* and 6*b*, directly or via recording system 6, and thence to front speakers 1*a* and 1*b*. By operating the 2-channel panoramic potentiometers 3*a* and 3*b*, sonic images 2*a* and 2*b* are localized respectively at any point in area L between speaker 1*a* and phantom source F1 and in area R between speaker 1*b* and phantom source F2. By moving the joysticks of the potentiometers 3*a* and 3*b* continuously, the localized images are moved continuously within the areas L and R.

Figure 32:
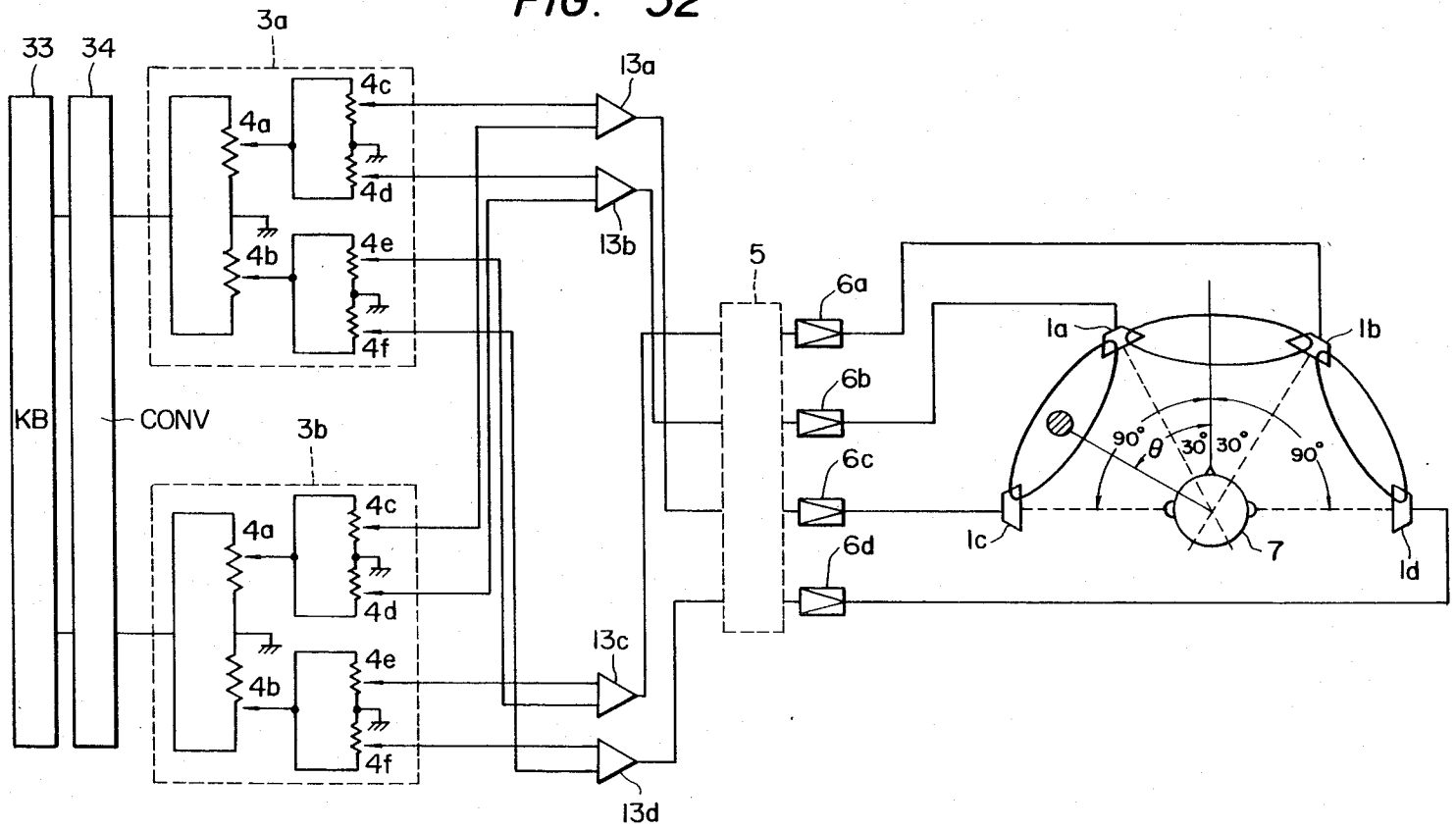
FIG. 32 is an illustration of a fifth embodiment of the invention in which signals from an electronic sound synthesizer are localized in a reproducing sound field.

The system of the present invention can be combined with an electronic musical instrument to localize sonic images of synthesized sound. FIG. 32 is an illustration of an example of such applications. The sound system shown in FIG. 32 is similar to the embodiment of FIG. 7 with the exception that the panoramic potentiometers 3*a* and 3*b* receive synthesized musical signals from an electronic musical sound source including a keyboard or switching circuit 32 which applies a selected one of signals supplied from an external synthesizer of a known construction to a sound converter 34 of the conventional design which modifies the waveform of the input signal into the musical note of a desired musical instrument. By continual movement of the joysticks of the potentiometers 3*a* and 3*b* the sonic images of the synthesized sound can be continually moved within the areas between speakers 1*a*, 1*b*, 1*c* and 1*d*.

What is claimed is:

1. A sound reproducing system comprising a pair of spaced apart first and second loudspeakers, at least one sonic localization network for deriving a pair of mutually related localizing audio signals from an input audio signal and applying said localizing signals to said loudspeakers respectively to develop a sound that is perceived by a listener as emanating from a phantom source on one side of said first loudspeaker which is remote from said second loudspeaker, a plurality of potentiometers for separating said input audio signal into a set of at least three audio signals and adjusting the levels of the separated signals relative to each other, two of said separated signals being supplied to said first and second loudspeakers, respectively, said localization network being responsive to the remainder of said separated audio signals to provide localizing signals to said first and second loudspeakers, respectively, so that said phantom sound source is located within an area external to an area which lies intermediate said loudspeakers, whereby the adjustment of one or more of said potentiomenters causes a sonic image produced by said phantom source to appear to move continuously with an area including said loudspeakers and said phantom sound source.

2. A sound reproducing system as claimed in claim 1, further comprising an additional potentiometer and an additional localization network connected to be responsive to provide localizing signals to said first and second loudspeakers respectively so that a sound is perceived by said listener as emanating from a second phantom source located in an area external to said intermediate area, the first-mentioned external area and said second area being located symmetrically with respect to said intermediate area.

3. A sound reproducing system as claimed in claim 1, wherein said phantom source is located on a line extending at right angles to a line positioned symmetrically with respect to said loudspeakers.

4. A sound reproducing system as claimed in claim 1, wherein six potentiometers are provided for generating six audio signals and four localization networks are connected respectively to four of said six audio signals to provide four pairs of localizing signals, the localizing signals of each pair being supplied respectively to said first and second loudspeakers, and the remainder of the six audio signals being applied respectively to said loudspeakers, whereby four sonic phantom sources are generated at locations angularly spaced apart in a circle.

5. A sound reproducing system as claimed in claim 1, further comprising a variable attenuator for scaling down the signal level of one of the outputs of said potentiometers.

6. A sound reproducing system as claimed in claim 1, further comprising a plurality of switches for connecting said input audio signal selectively to one or more of said potentiometers.

7. A sound reproducing system as claimed in claim 1, further comprising means for generating a primary echo signal from one of said separated audio signals and applying said primary echo signal through said localization network to said loudspeakers, whereby acoustic echoes are made to appear to originate from said phantom sound source.

8. A sound reproducing system as claimed in claim 7, further comprising means for generating a plurality of said primary echo signals, each echo signal having a different delay time with respect to the other echo signals, and a plurality of additional panoramic potentiomete4rs respectively supplied with said primary echo signals, an adder for combining the output signals of each of said additional panoramic potentiometers to generate a plurality of combined primary echo signals, a portion of said combined primary echo signals being applied through a plurality of said localization networks to said loudspeakers to generate at least two phantom sound sources and the remainder being applied directly to said loudspeakers.

9. A sound reproducing system as claimed in claim 1, further comprising means for deriving from one of said separated audio signals a reverberation signal and applying said reverberation signal through a plurality of said localization networks to said loudspeakers.

10. A sound reproducing system as claimed in claim 9, further comprising means for delaying said reverberation signal with respect to said input audio signal by an amount greater than the maximum delay time of said primary echo signals.

11. A sound reproducing system as claimed in claim 9, further comprising means for applying said reverberation signal through said additional panoramic potentiometers and combining the reverberation signal with said primary echo signals.

* * * * *